US010876309B2

(12) United States Patent
Lewis

(10) Patent No.: US 10,876,309 B2
(45) Date of Patent: Dec. 29, 2020

(54) POOL COVER ANCHOR

(71) Applicant: VOICE TECHNOLOGY SOLUTIONS, INC., East Patchogue, NY (US)

(72) Inventor: Stephen Michael Lewis, East Patchogue, NY (US)

( * ) Notice: Subject to any disclaimer, the term of this patent is extended or adjusted under 35 U.S.C. 154(b) by 0 days.

(21) Appl. No.: 16/200,929

(22) Filed: Nov. 27, 2018

(65) Prior Publication Data

US 2019/0161987 A1 May 30, 2019

Related U.S. Application Data

(60) Provisional application No. 62/591,312, filed on Nov. 28, 2017.

(51) Int. Cl.
*E04H 4/00* (2006.01)
*E04H 4/10* (2006.01)
(Continued)

(52) U.S. Cl.
CPC ..... *E04H 4/10* (2013.01); *E04H 4/06* (2013.01); *E04H 4/14* (2013.01)

(58) Field of Classification Search
CPC .. E04H 4/06; E04H 4/10; E04H 4/108; E04H 15/02; E04H 15/36; F16B 5/0692;
(Continued)

(56) References Cited

U.S. PATENT DOCUMENTS 2,465,621 A 3/1949 Wheeler
2,815,809 A 12/1957 Jacobs
(Continued)

FOREIGN PATENT DOCUMENTS

FR 2 885 630 11/2006
WO WO 2012/088040 6/2012

OTHER PUBLICATIONS

Press Fit Engineering & Design Calculator, Machinery's Handbook, 29th Ed., available at: www.engineersedge.com/calculators/machine-design/press-fit/press-fit-calculator.htm, Nov. 20, 2018 (Year: 2018).*
(Continued)

*Primary Examiner* — Charles Cheyney
(74) *Attorney, Agent, or Firm* — Thomas A. O'Rourke; Bodner & O'Rourke, LLP

(57) ABSTRACT

A pool cover anchor system, for use on deck boards surrounding the pool, includes first and second anchor parts. The first anchor part includes: a first portion having an opening; a second portion that extends away from the first portion; and an anchor member that extends away from the first portion for a hook of the pool cover to be mounted thereto. The second anchor part includes: a first portion pivotally received in the opening in the first anchor part; and a second portion that extends away from the first portion of the second anchor part. The opening in the first anchor part is positioned a distance away from the second portion of the first anchor part for each of the second portion of the first anchor part and the second, portion of the second anchor part to respectively bear against two different deck boards simultaneously, and distribute loads therebetween.

7 Claims, 20 Drawing Sheets

(51) Int. Cl.
*E04H 4/06* (2006.01)
*E04H 4/14* (2006.01)

(58) Field of Classification Search
CPC .. F16B 5/0635; F16B 5/06642; F16B 5/0657; B63B 21/04; B63B 21/00; B63B 21/045; B63B 21/24
USPC ..... 4/498, 50; 114/218, 230.29, 230.1
See application file for complete search history.

(56) References Cited

U.S. PATENT DOCUMENTS 2,958,872 A 11/1960 Meyer
3,229,309 A 1/1966 Knodel
3,264,656 A 8/1966 Clay
3,373,464 A 3/1968 Ausnit
3,523,308 A 8/1970 Bradley
3,533,110 A 10/1970 Gisondi
3,534,412 A 10/1970 Crook
3,608,099 A 9/1971 Wall
4,297,963 A * 11/1981 Beacom ..... E02B 3/24 114/218
4,344,378 A * 8/1982 Martin ..... B63B 21/045 114/218
4,459,711 A 7/1984 Sartain
4,757,854 A 7/1988 Rippberger
4,790,037 A 12/1988 Philips
4,939,798 A 7/1990 Last
5,065,461 A 11/1991 Shehan
5,259,078 A 1/1993 Crandall
5,184,377 A 2/1993 Ragsdale
5,371,907 A 12/1994 Horvath
5,542,367 A * 8/1996 DuBois, III ..... E02B 3/24 114/218
5,800,089 A 9/1998 Donaton
5,967,075 A * 10/1999 Johansen ..... A47B 23/02 114/218
6,026,522 A 2/2000 Last
6,442,773 B1 * 9/2002 Kopyar ..... E04H 4/108 4/498
6,647,911 B1 * 11/2003 Solterbeck ..... B63B 21/04 114/230.26
6,793,189 B1 * 9/2004 McKay ..... B63B 21/04 114/218
6,893,073 B2 5/2005 Wheatley
7,144,004 B1 * 12/2006 Conversa ..... B25B 5/061 269/47
7,789,033 B2 * 9/2010 Doig ..... B63B 21/00 114/230.15
8,327,575 B1 * 12/2012 Zalewski ..... 248/519
8,713,899 B2 5/2014 Buttner
2005/0246997 A1 11/2005 Bishop
2007/0292229 A1 * 12/2007 Andrew ..... E04B 9/18 410/101

OTHER PUBLICATIONS

Press Fit Engineering St Design Calculator, Machinery's Handbook, 29th Ed., available at: www.engineersedge.com/calculators/machine-design/press-fit/press-fit-calculator.htm.

* cited by examiner

FIG. 3
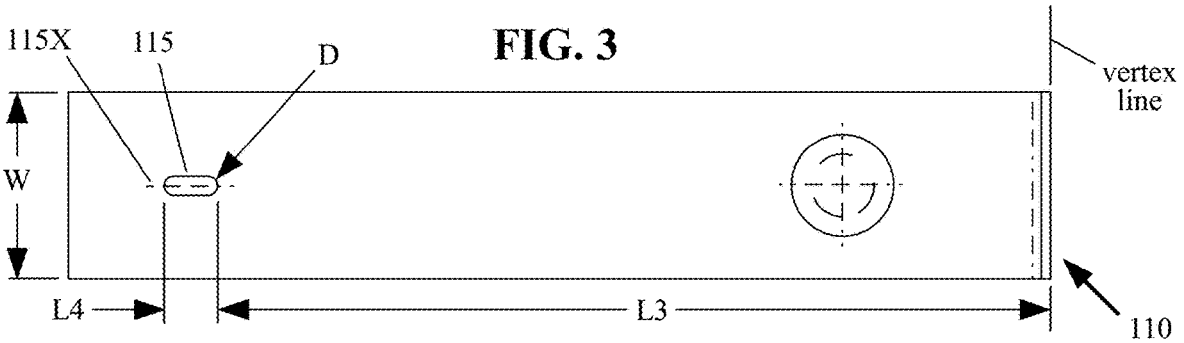
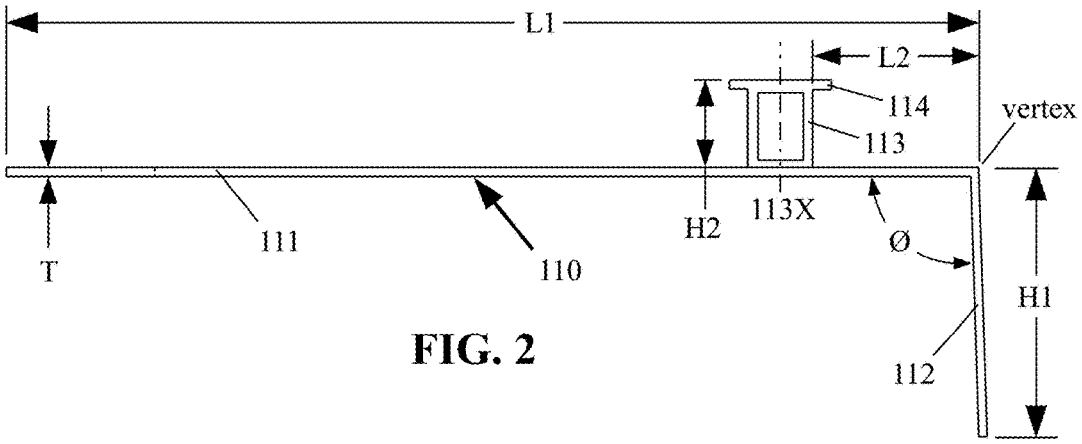
FIG. 2
FIG. 4
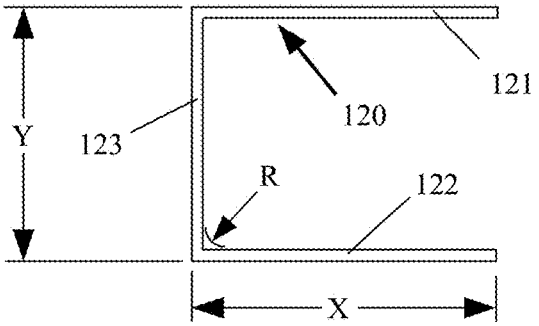
FIG. 5
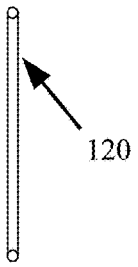
FIG. 1
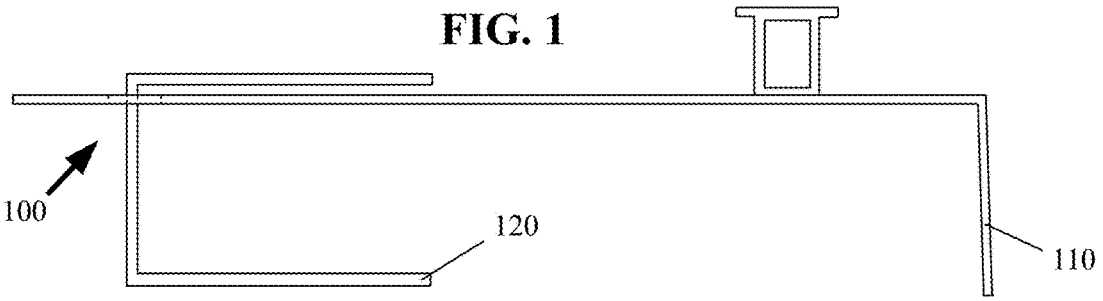

FIG. 7A
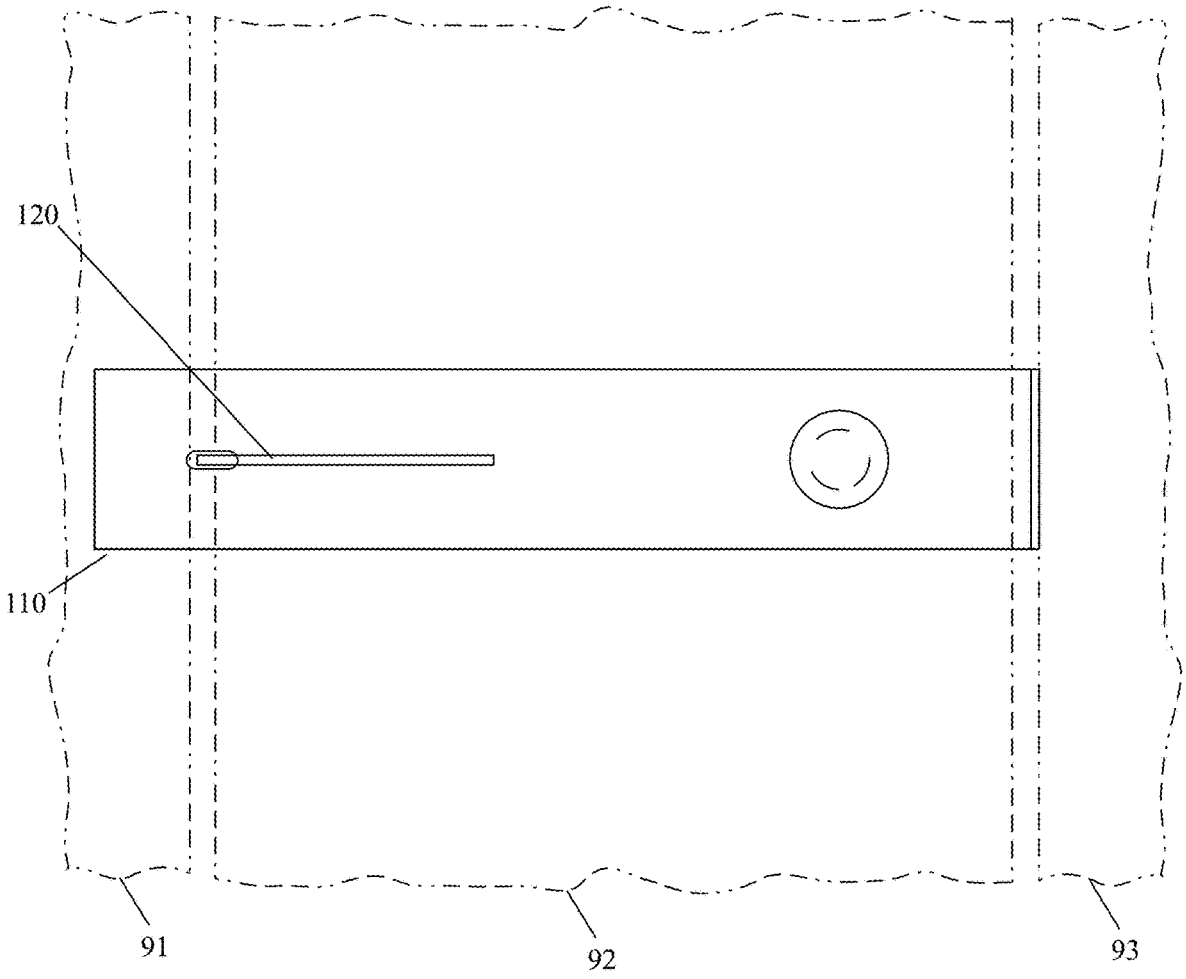
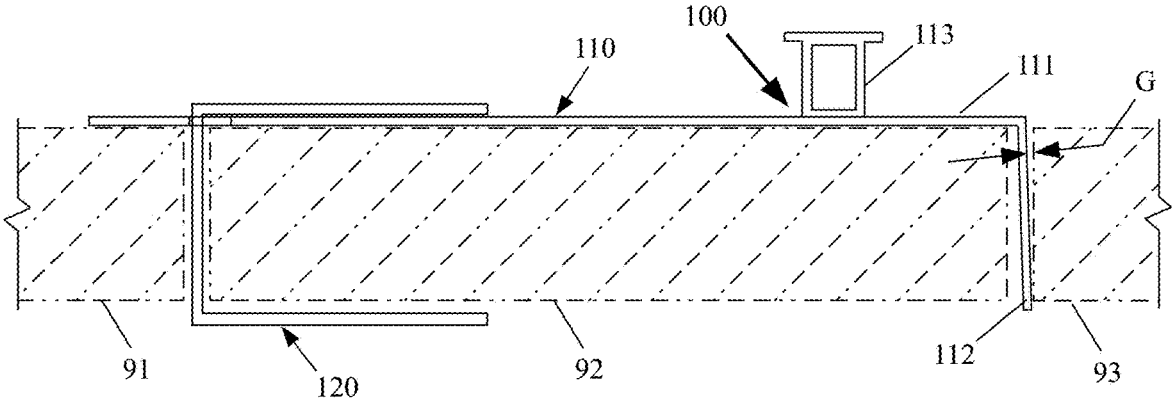
FIG. 7B

FIG. 15
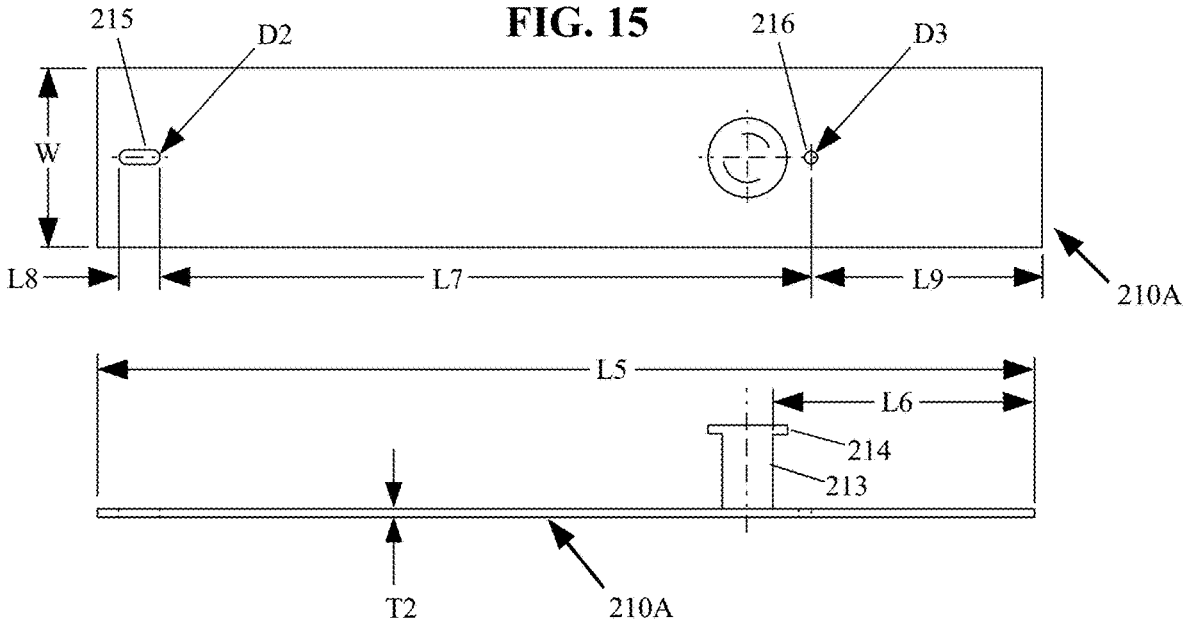
FIG. 16
FIG. 17
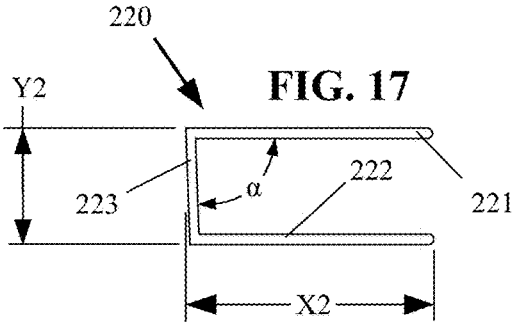
FIG. 18
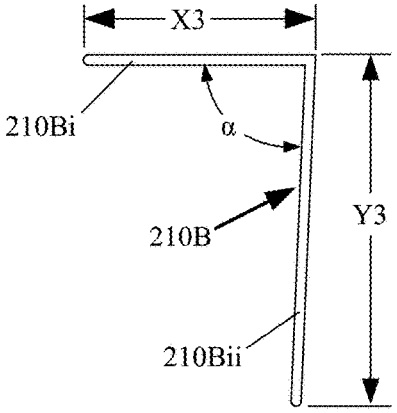

FIG. 21
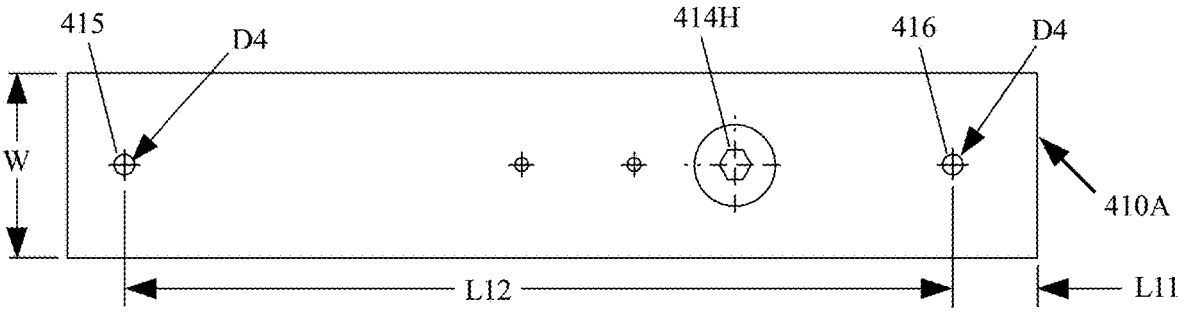
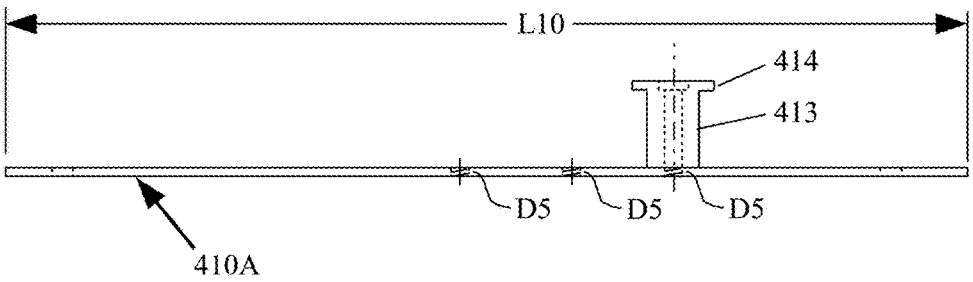
FIG. 22
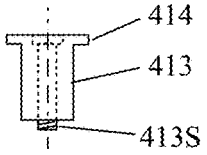
FIG. 22A
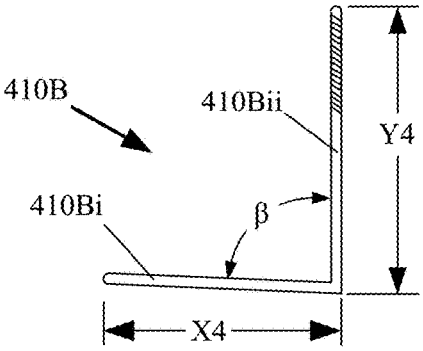
FIG. 23

POOL COVER ANCHOR

CROSS REFERENCES TO RELATED APPLICATIONS

This application claims priority on U.S. Provisional Application Ser. No. 62/591,312 filed on Nov. 28, 2017, the disclosures of which are incorporated, herein by reference.

FIELD OF THE INVENTION

The disclosure herein relates to pool cover anchors, and more particularly to an improved anchoring system for securing a pool cover to the surrounding deck boards, which, anchoring system all but eliminates anchors being pulled out of the deck, leaves the deck, surface undamaged and safe when the cover and associated anchoring units are removed, and also applies the load from the pool cover between two adjacent boards.

BACKGROUND OF THE INVENTION

Draining and refilling a pool with water every season, whether and in-ground pool or an above-ground pool, is not per se an expensive proposition, but it is a time-consuming task, and one that is cautioned against for many reasons. Many pool experts instead, recommend only lowering the water level in the pool to be just below the skimmer level and below the jets, to ensure that all of the plumbing lines are tree of water, in order to prevent expansion and bursting during the cold winter months. It is also recommended to leave as much water in the pool as possible, to otherwise prevent rips and tears to a liner, which could dry out, shrink, and/or crack.

Although it is possible to leave the pool uncovered during the winter, it creates additional pool maintenance unless the water is frozen. For example, the fallen leaves in the pool water use up algaecide, and can leave stains, so in the dead of winter the pool owner would otherwise have to continue to clean the pool. For that reason, nearly all pool owners north of the Sunbelt cover their pool in the winter months.

Many in-ground pools, and even some above-ground pools are surrounded by wood or composite decking. Various forms of pool covers are available for in-ground pools including the popular spring-loaded safety covers which are manufactured by Loop-Loc, Ltd., of Hauppauge, N.Y., Meyco Product, Inc., Merlin Industries, Inc. along with several other manufacturers. Virtually all of these spring-loaded covers are secured to the decking via anchors that are drilled and screwed into the decks. This form of anchor has limitations including that, they must be permanently installed in the deck in the exact right position, can and often partially or completely pull out of the decking, places all of the force caused by the tension and weight of the cover (including additional weight such as snow) on a very small area of one board and associated screws and can cause a safety risk when left in the 'up' position. The pool cover anchor disclosed herein solves this problem.

OBJECTS OF THE INVENTION

It is an object of the invention to provide an anchor for supporting a pool cover with respect to decking that surrounds the pool.

It is another object of the invention to provide a quick and easily installable anchor for supporting a pool coyer with respect to the surrounding deck boards of a pool.

It is a further object of the invention to provide an anchor for supporting a pool cover with respect to surrounding decking that does not permanently attach to the wood/composite/metal decking.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment, a pool cover anchor may broadly include a multi-part mechanical fastener. The fastener allows a particular type of pool cover, including one brand sold under the trademarked name of loop-Loc® (and certain other covers sold for example by Meyco, and Merlin), to be installed with respect to a standard wooden (or metal or composite) deck, without any penetrations being made into the deck, surface, such as by drilling holes and screwing anchors into the decking.

The first part of the anchor is a piece of flat metal with several holes drilled at specific locations that are used, to secure the additional parts of the anchoring system, to the decking. Attached to the first part of the anchor is a round metal "post" component with a small lip on the top of the post. The post bottom is securely attached to the top of the flat metal, where the "top" is the surface portion of the metal away from the deck surface.

The additional parts of the anchor are small diameter round metal stock made in such a fashion as to slide through the holes in part one, slide between adjacent deck boards, are turned so they clip under the boards and then are locked to part one via a 'U' shaped clamp or a wing nut that is tightened against the top of part one.

Once the anchor is in place, the "straps of the pool cover, which have metal loops on the end of each strap, can then be secured over the anchor post of the first part.

With the part two clamps secured, the lateral and vertical pressures exerted when the cover is installed, is be distributed between two boards as opposed to only one board, which may be characteristic of some traditional deck anchor systems that are screwed into a single board.

The quantity of required anchors may depend on the number of straps and associated strap loops on the pool cover.

BRIEF DESCRIPTION OF THE DRAWINGS

The description of the various example embodiments is explained in conjunction with appended drawings, in which:

FIG. 1 illustrates a side view of a first embodiment of a pool cover disclosed herein, which includes a first part and a second part;

FIG. 2 illustrates a side view of the first part, of the pool cover anchor of FIG. 1;

FIG. 3 illustrates a top view of the first part shown in FIG. 2;

FIG. 4 illustrates a side view of the second part of the pool anchor of FIG. 1;

FIG. 5 is an end view of the second part shown in FIG. 4;

FIG. 7A is the top view of FIG. 6A, but is shown with the pivotable part of the anchor rotated to be oriented to be perpendicular to the deck boards;

FIG. 7B is the side cross-sectional view of FIG. 7A, but is shown with the pivotable part of the anchor oriented to be perpendicular to the deck boards;

FIG. 15 illustrates a top view of the first part for a second embodiment of a pool cover anchor as disclosed herein;

FIG. 16 illustrates a side view of the first part shown in FIG. 15;

FIG. 17 illustrates a side view of a second part usable with the first part shown in FIG. 16 for the second embodiment of a pool cover anchor;

FIG. 18 illustrates a side view of a third part usable with the first part shown in FIG. 16 for the second embodiment of a pool cover anchor;

FIG. 21 illustrates a top view of the first part for a fourth embodiment of a pool cover anchor as disclosed herein;

FIG. 22 illustrates a side view of the first part shown in FIG. 21;

FIG. 22A illustrates a detail view an alternative embodiment of the post that may be used for the first part shown in FIG. 21;

FIG. 23 illustrates a side view of a second part usable with the first part shown, in FIG. 22 for the fourth embodiment of the pool cover anchor;

DETAILED DESCRIPTION OF THE INVENTION

Figure 6A:
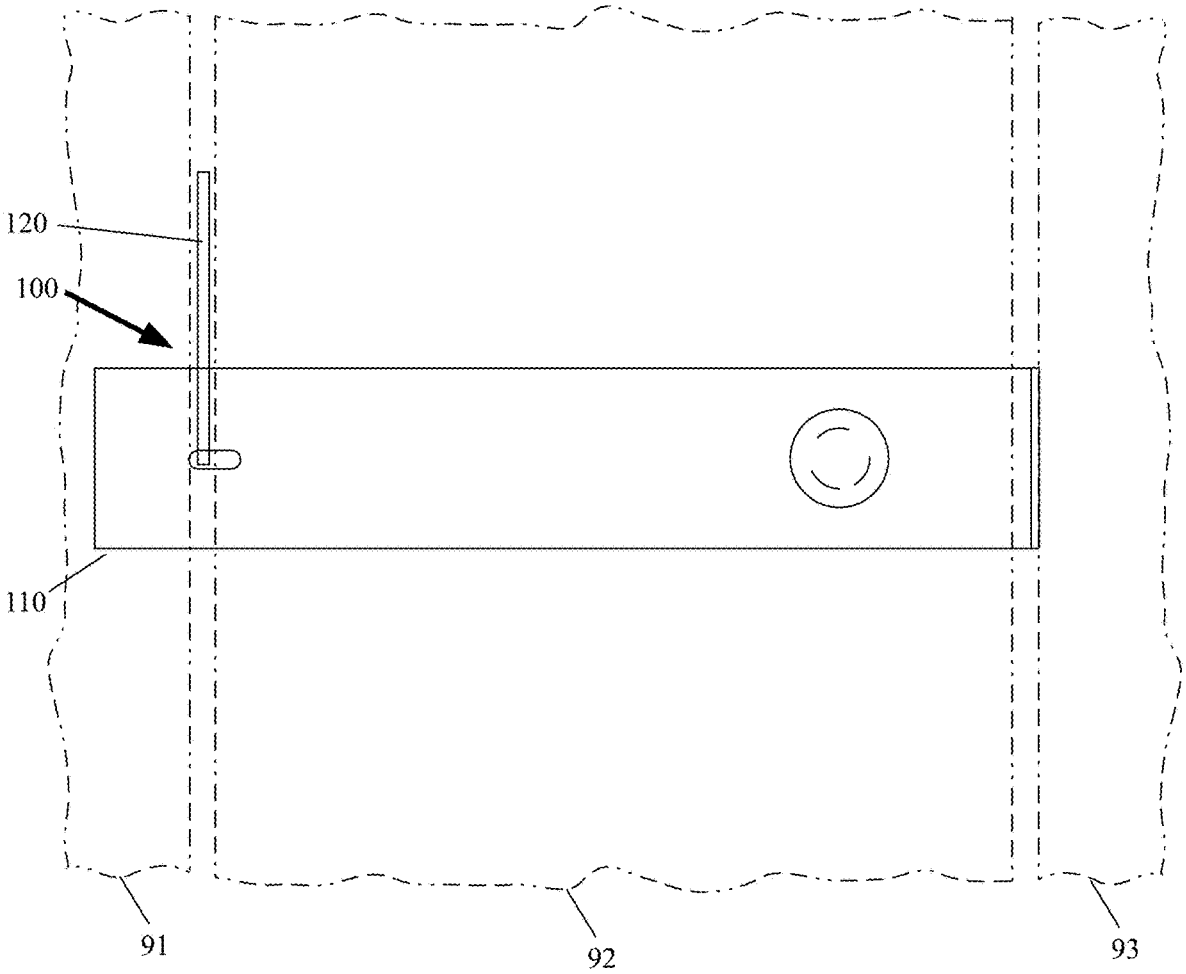
FIG. 6A shows a top view of the anchor of FIG. 1 above the decking surrounding a pool, to which the anchor is to be secured, with the pivotable part of the anchor shown oriented to be parallel with the deck boards.

As used throughout this specification, the word "may" is used in a permissive sense (i.e., meaning having the potential to), rather than a mandatory sense (i.e., meaning must), as more than one embodiment of the invention may be disclosed herein. Similarly, the words "Include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B. and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed apparatus.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical, difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of multiple individual tolerances.

Any use of a friction fit (i.e., an interface fit) between two mating parts described herein may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit (e.g., for a 0.1250 inch shaft diameter the opening may be 0.1285 inches for a close fit and may be 0.1360 inches for a tree (running) fit; and for a 0.5000 inch diameter shaft size the opening may be 0.5156 inches for a close clearance fit and may be 0.5312 inches for a free clearance fit). Other clearance amounts may also be used.

Many pools today are surrounded by a deck made of standard deck boards, i.e., 5/4×6 deck boards (which actually measure 1 inch by 5.5 inches). Most installers of such, deck boards usually temporarily position a nail between the adjacent boards as a spacer, prior to securely fastening the subsequent deck board to the underlying structure (i.e., to the joists). Those deck installer typically place an 8D to a 16D nail between the deck boards. The 8D nail has a nominal shank diameter of 0.134 inches, and the 16D nail has a nominal shank diameter of 0.165 inches, which usually results in the deck boards being spaced roughly 5/32" to 3/16" apart. When hidden or side board fastening systems are used for wood or composite decks, it results in a board-to-board spacing of approximately a 1/4" or less.

Various embodiments disclosed herein are particularly configured to utilize such a very narrow spacing/gap between deck boards to thereby support an anchor for the aforementioned pool covers.

A pool cover anchor bracket system 100, as seen in FIG. 1, may broadly include a first anchor part 110 (FIGS. 2-3), and a second anchor part 120 (FIGS. 4-5), where the second anchor part is movably coupled to the first anchor part.

The first part 110 may be formed of a first generally flat plate portion 111 and a second generally flat portion 112. In one embodiment, the second portion 112 may be at an angle of roughly 90 degrees with respect to the first portion 111. In another embodiment, the second portion 112 may be at an angle of roughly 95 degrees with respect to the first portion 111, as shown in FIG. 2. In other embodiments, other bend angles may be used, e.g., 96 degrees, 98 degrees, 100 degrees, etc., which angle may be correlated to the thickness of the plate material utilized, and the size/weight of the pool cover being supported, to produce a particular plate deflection that is discussed hereinafter.

In one embodiment the first portion 111 and the second portion 112 may be flanges of a single bent-up sheet metal first part 110. In another embodiment, the first, portion 111 and the second portion 112 may be formed as separate sheet metal parts that may be welded, together to form the first part 110, or may be formed as a casting or machining, or by any other suitable manufacturing process. It is also noted that any other suitable geometric shapes may also be used instead of the noted flanges.

The second portion 112 may have a height H1 from the vertex, which may vary, depending upon the particular dimensions of the decking that the anchor system 100 is to be used with, and upon the particular angle θ that is utilized. In one embodiment, where the angle θ is roughly 95 degrees (i.e., within ordinary manufacturing tolerances for a nominal 95 degree angle e.g., plus or minus 3 degrees), and where standard 5/4×6 deck boards surround the pool (i.e., 1 inch by 5.5 inch deck boards), the height H1 of the second portion 112 may be greater than one inch (i.e., greater than the thickness of the deck board) and may in one embodiment be roughly 1.75 inches. The length L1 of the first portion 111 may be greater than six inches (i.e., greater than the width of the deck board) and may be roughly 6.5 inches in one embodiment (i.e., it may sufficiently greater than the length of the deck board to permit coupling of the second part thereto and prevent tear-out or other failure of the second part due to loads applied by the pool cover), and the width W may be roughly 1.25 inches in one embodiment. Other dimensions for the parts may also be used in other embodiments.

An anchor member, which may be in the form of post 113, may be fixedly secured to the top of the first portion 111, and may have an overhanging flange 114 to prevent the hook of the pool cover from sliding off, as discussed hereinafter. The post 113 may be fixedly secured to the top of the first portion 111 using mechanical fasteners, or by being welded thereto, or by any other suitable means known in the art. Alternatively, the post may be integrally formed with the first portion 111. In one embodiment, the post may be cylindrical, and the overhanging flange may be a concentric cylinder or annular member, etc. A post with an oval cross-sectional shape, or a rectangular cross-sectional shape, or a square cross-sectional shape, or an octagonal cross-sectional shape may be used. Other geometric shapes may alternatively be used (i.e., a flange with a hole into which the hook of the pool cover may be hooked, rather than being hooked around the anchor member itself). The side of the post nearest to the vertex may be positioned a distance L2 away from the vertex, as shown in FIG. 2, and may have a height H2. In one embodiment, the distance L2 may be roughly 1 inch, and the height H2 may be roughly 0.5 inches. In the embodiment where a cylindrical post is used, the size of the post 113 cross-section (e.g., the diameter of the cylinder) may be determined by the size of the hook of the pool cover attachment, with the post, being slightly smaller than the hook, and may, for example range between 0.25 inches and 1.25 inches. The amount of overhang by the flange 114 overhanging the cylinder may be approximately the same as or slightly greater than the thickness of the hook on the pool cover attachment that may be retained thereon (see FIG. 8), to prevent it from sliding off. In other embodiments, other dimensions may also be used, which is also true of the exemplary dimension cited for the following embodiments.

The first portion 111 may also have an opening formed therein. The opening may take one of many different forms. In one embodiment, an opening 115 may be a slotted hole that may have a diameter D, and a length L4 that may begin a distance L3 from the vertex, as shown in FIG. 3 and FIG. 4. The axis 115X of the slotted opening 115 may be oriented along the length-wise direction of the first part and may thus be substantially perpendicular to the line formed by the intersection of the outer planar surfaces of the first portion 111 and the second portion 112 (i.e., perpendicular to the vertex line shown in FIG. 3). Also, for optimum loading of the anchor system 100 by the proportional weight of the pool cover being transferred to the post 113 by the attachment hook of the cover, the axis 113X of the cylinder 113 may be substantially perpendicular to, and coplanar with, the axis 115X of the slotted opening 115. In one embodiment, the diameter D may be 3/16 of an inch, and the length L4 may be 3/8 of an inch, plus or minus 0.030 inches, based upon the exemplary dimensions for the second anchor part 120 that are discussed hereinafter. In one embodiment, the slotted opening 115 may begin roughly at a distance L3 of 5.5 inches from the vertex line, as shown in FIG. 3. Also, in one embodiment, the thickness T may be 1/16 of an inch. In yet another embodiment, an oversized circular hole may be used instead of a slotted hole.

The second part 120 may be formed to be substantially channel-shaped or U-shaped, as seen in FIG. 4 and FIG. 5, having a first leg 121, and a second leg 122, which may extend from opposite ends of a base 123. The legs 121/122 and base 123 of the second part 120 may be formed, using any suitable cross-sectional shape, including, but not limited to, a circular cross-sectional shape, a square cross-sectional shape, an octagonal cross-sectional shape, etc. The second part 120 may be a welded part and may have squared-off interior corners, as shown in FIG. 4, or alternatively it may be a bent-up part with inside radii R, which radius may preferably be formed to be smaller than the rounded edges of the deck boards, and may, for example, be between a 0.010 inch and a 0.063 inch radius. The legs 121/122 may each extend a total distance X from the base 123, as seen in FIG. 4, and the base 123 may extend a distance Y. In one embodiment, the legs 121/122 and base 123 may be formed from 1/8 inch (0.12") round stock that may be bent into the U-shape, which would provide sufficient strength, and would fit between the above-noted minimum, gap between the deck boards (i.e., a 0.134" spacing when the 8D nail is used for spacing boards). In one embodiment the bend radii may be in the range of 0.01 inches to 0.063 inches. In another embodiment, the bend radii may be in the range of 0.063 inches to 0.12 inches, which may depend upon the material utilized, and the size of the opening 115. Also, in one embodiment, where standard 5/4×6 deck boards surround the pool (i.e., 1 inch by 5.5 inch deck boards), the legs 121/122 may each extend a total distance X away from the base that is greater than the hoard spacing, and in one embodiment it may extend a distance of 2.0 inches from the base 123, and the base may extend a distance Y that is greater than the combined thickness of the boards and the thickness of the legs 121/122, and in one embodiment it may extend a distance of 1 1/8 inches, for suitable engagement with the deck boards. The above cited diameter D of 3/16 inch for the slotted opening 115 is slightly oversized, to accommodate the embodiment of the second part 120 that may use the 1/8 inch round stock, providing a nominal clearance of roughly 1/16 of an inch. Also, the above cited length L4 of 3/8 of an inch for the opening 115 in the first part 110 may permit the bends of the U-shaped second part 120 to be inserted into the slotted hole, to be positioned therein, as shown in FIG. 1. Also, the above cited, length L4 of 3/8 of an inch for the opening 115 (in combination with the length L3) may also permit proper positioning of one end of the slotted hole to facilitate bearing against the base 123 of the second part 120, for clamp up against the adjacent deck board, as discussed hereinafter.

Figure 6B:
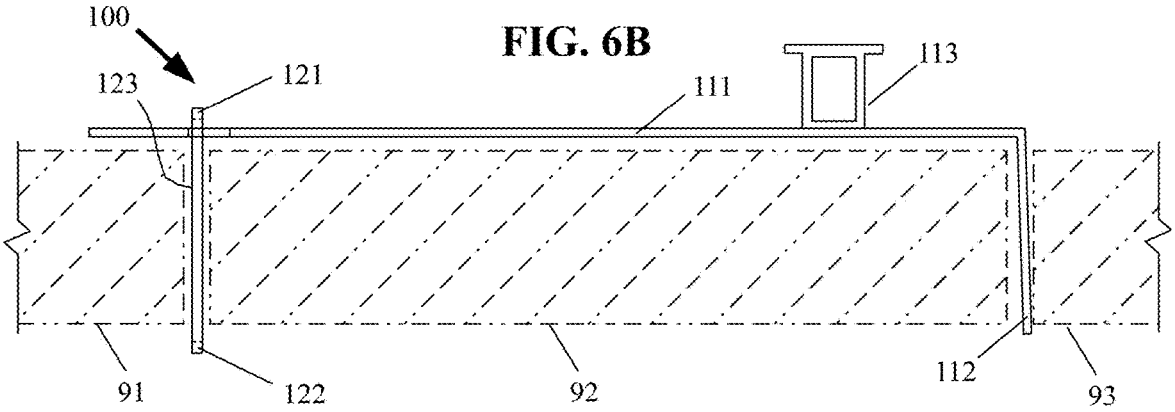
FIG. 6B shows a side cross-sectional view of the pool deck boards of FIG. 6A, with portions of the anchor of FIG. 1 inserted between adjacent boards.

Installation of the anchor system 100, as seen initially in FIG. 6A, may begin by orienting the legs 121/122 of the second part 120 to be parallel to the direction of the deck boards 91/92. Next the anchor system 100 may be lowered towards the decking, so that the base 123 of the second part 120 may be positioned in the gap between two adjacent deck boards (i.e. between boards 91 and 92), and so that the second portion 112 of the first part 110 may be positioned between deck boards 92 and 93, as shown in FIG. 6B. The second leg 122 may then be positioned below the bottom surface of the deck boards.

The second part 120 may then be pivoted roughly 90 degrees with respect to the first part 110 to be perpendicular to the direction of the deck boards and be lacing towards the flanged cylindrical post 113, as shown in FIG. 7A. The second part 120 is then positioned with one leg (e.g., 121) above the deck board 92, and the other leg (e.g., 122) below the deck board. As seen in FIG. 7B, there may be a non-linear gap G between the second portion 112 and the side of the deck board 93, where a non-ninety degree angle θ is used (e.g., 95°) for the substantially planar second portion 112 with respect to the substantially planar first portion 111, which first portion may rest on top of the deck board 93.

Figure 8:
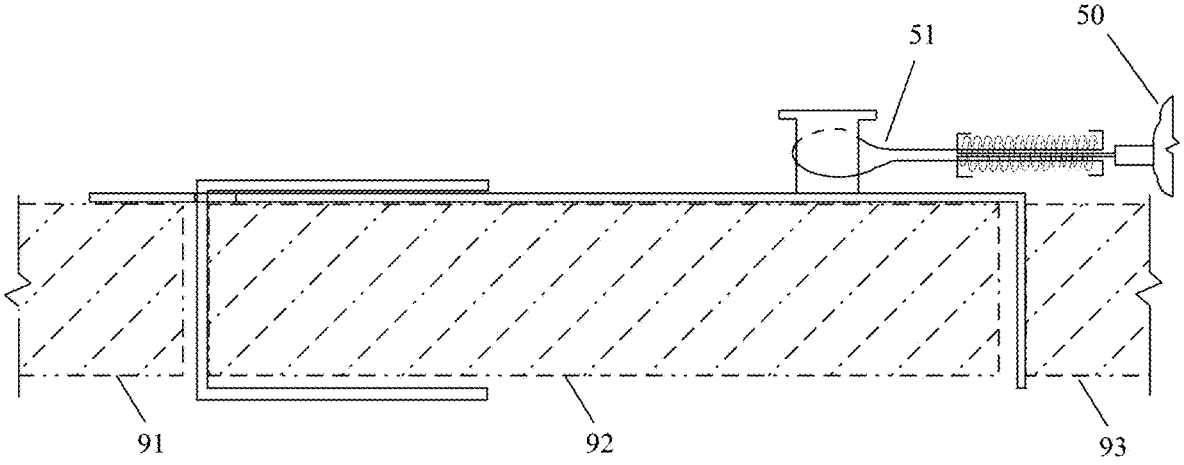
FIG. 8 is the side cross-sectional view of FIG. 7B, but is shown with the hook of a pool cover strap secured to the post of the anchor, causing the anchor to clamp up on two adjacent deck boards.
Figure 9:
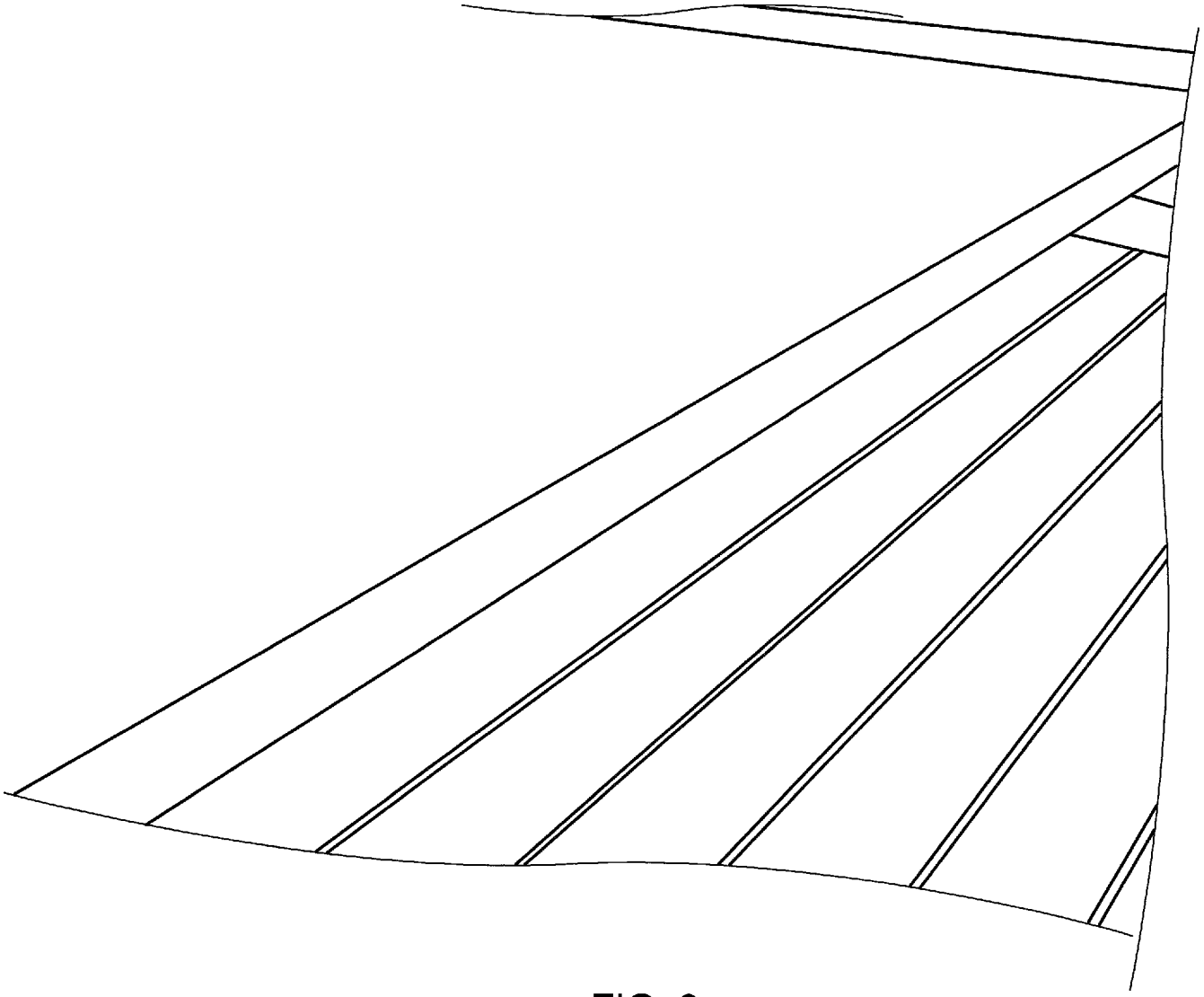
FIG. 9 illustrates a pool surrounded by decking.
Figure 11:
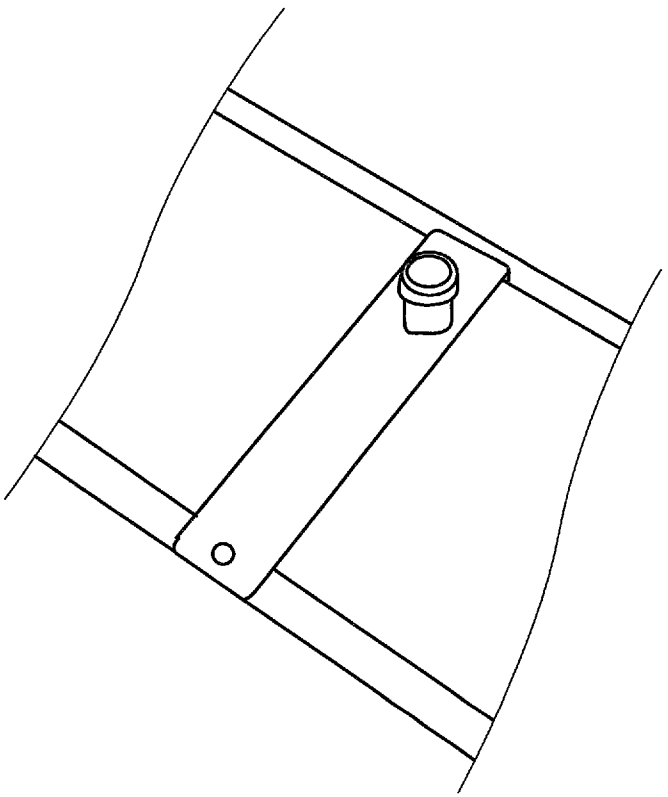
FIG. 11 illustrates the first part of the pool anchor of FIGS. 2-3, shown with the bent flange inserted between two adjacent deck boards.
Figure 10:
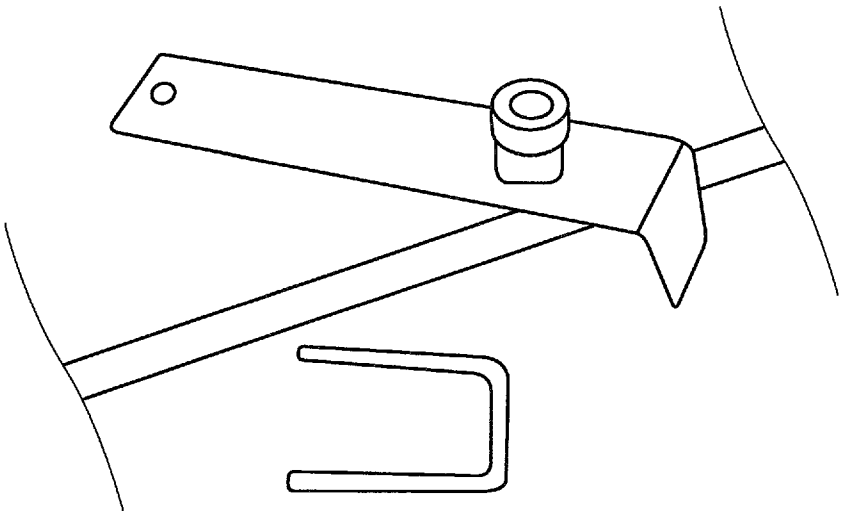
FIG. 10 illustrates the first part and the second part of the pool cover anchor of FIG. 1, shown prior to being assembled, and shown positioned, on top of the pool decking of FIG. 9.
Figure 13:
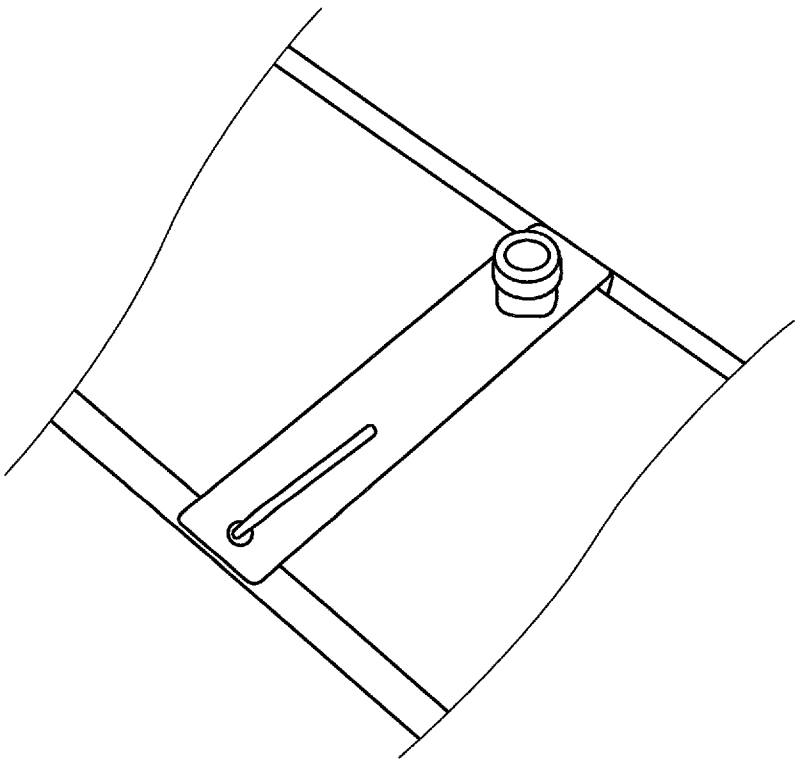
FIG. 13 is a perspective view illustrating the pool cover anchor of FIG. 12, shown with the second part having been rotated to be aligned with the axis of the first part, to secure the system to the deck board.
Figure 12:
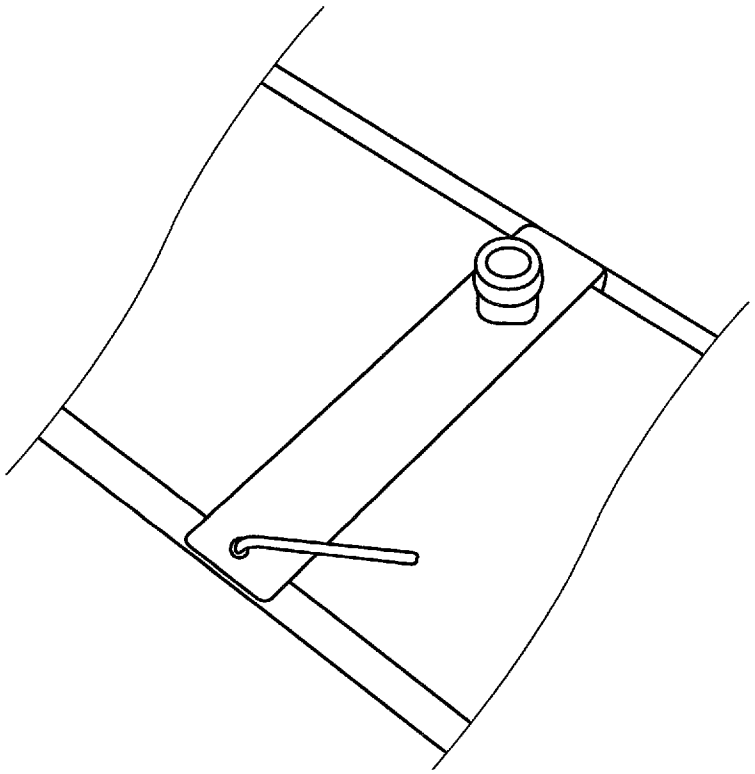
FIG. 12 illustrates the first part of the pool cover anchor with the bent flange inserted between two adjacent deck boards, as shown in FIG. 11, and with the second, part coupled to the first part, and having been rotated away from the 90 degree position.
Figure 14:
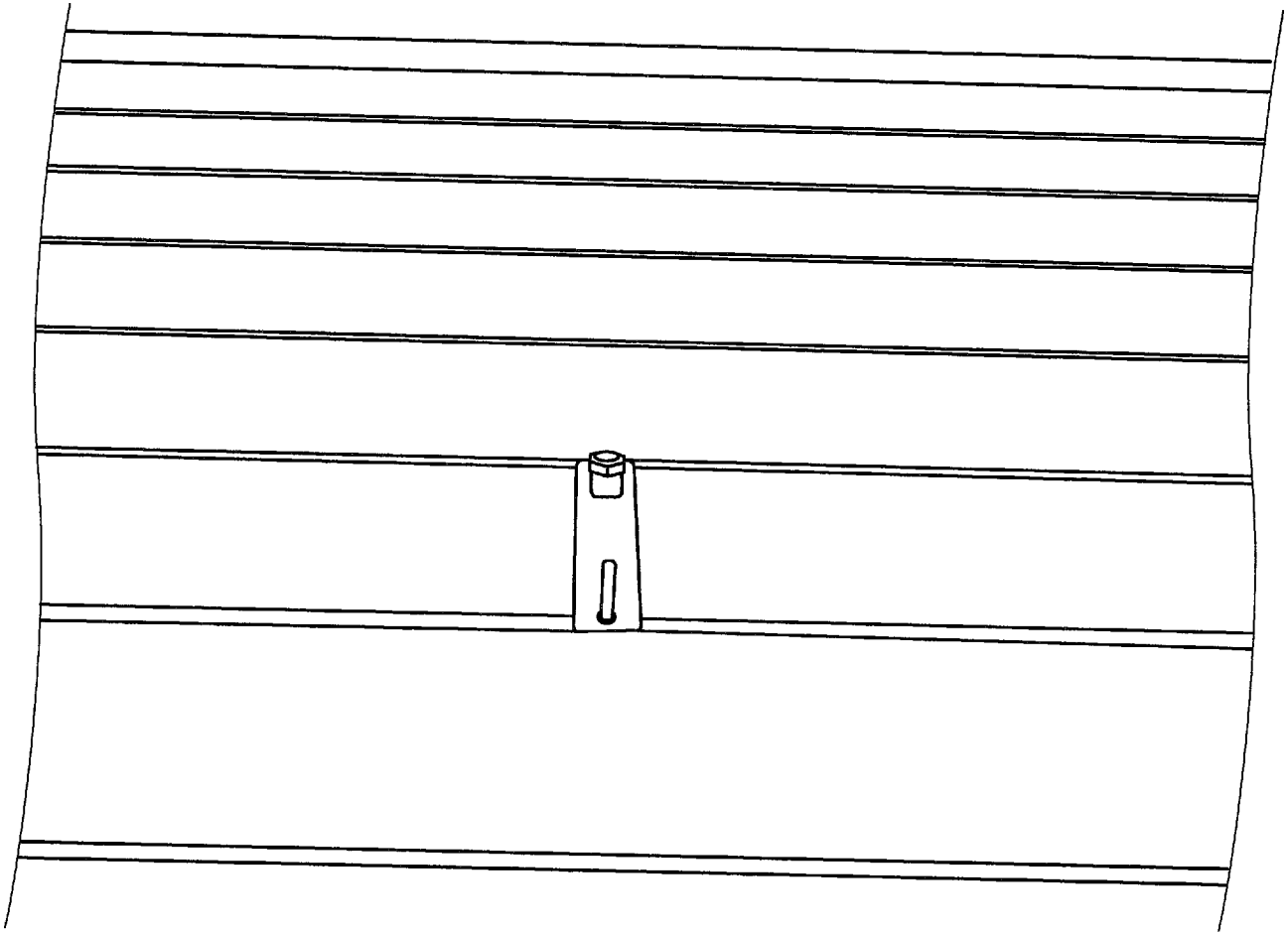
FIG. 14 is a second perspective view of the installed anchor shown in FIG. 13.

When the hook 51 of the pool cover 50 is stretched and secured upon the flanged post 113, as shown in FIG. 8, the force thereby applied to the post may cause the angle between the second portion 112 and first portion 111 to deform until the angled gap G has been eliminated, and the side of the second portion 111 is substantially flush against the side of the deck board 93 (i.e., deformation has caused the non-ninety degree angle θ to become 90 degrees). At the same time, the end of slotted hole 115 may be caused to bear against the base 123 of the second part 120, and thereafter cause the base to bear up against the side of the deck board 92, as shown in FIG. 8.

With this arrangement, each anchor bracket system 100 is bearing against two different deck boards (e.g., boards 92 and 93) simultaneously, and is distributing both the lateral and vertical loads applied by the pool cover between those boards, instead, of only loading a single deck board. For this reason, and because of the configuration of the anchor bracket system 100, there is less of a tendency towards pulling out the deck boards away from the joists to which they are nailed or otherwise attached. (Note that this arrangement may also be achieved by initially using an angle θ of 90 degrees).

Figure 19:
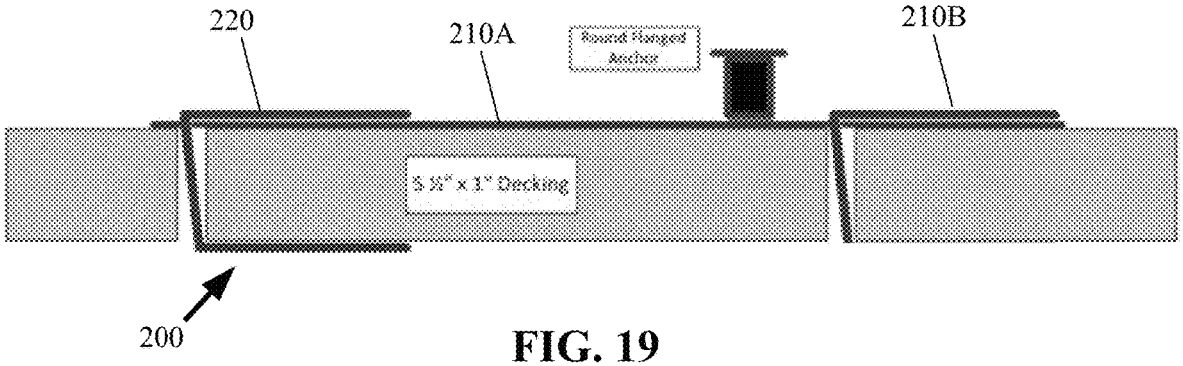
FIG. 19 shows the first, second, and third parts of FIGS. 16-18 assembled together and installed with respect to a series of deck boards.

The parts that may be used to form a second anchor bracket system 200 are shown in FIGS. 15-18, with the bracket system shown installed with respect to deck boards in FIG. 19. The anchor bracket system 200 may include a part 220 that may be formed similar to the part 120 of the first bracket system 100, except that the U shape may be skewed, i.e., the legs 221/222 may be parallel to each other, but may each be at an angle α to the base 223, which angle α may be similarly chosen as the angle θ for the anchor bracket system 100, as discussed hereinafter. In one embodiment, the length X2 of the legs 221/222 may be roughly 2 inches, the legs may be spaced a distance Y2 of 1.38 inches apart, and it may be made of 3/16 inch round stock. Also, the part 110 of the first bracket system 100 may be replaced by a two-part arrangement for the bracket system 200 that includes the part 210A, and the part 210B, respectively shown in FIGS. 15-16 and FIG. 18. The part 210A may be a flat plate with a slotted hole 215, and a post 213, having a flange 214, formed similar to the post 113 for the first portion 111 of the part 110 of the first bracket system 100.

The part 210A may also have a hole 219 formed therein. In one embodiment of the part 210A, the thickness T2 may be 0.12 inches, and its overall, length L5 may be roughly 8 inches. Also, in one embodiment, the post distance L6 may be roughly 2.5 inches from the closest end, the slotted hole 215 may be formed with a diameter D2 of 7/32 of an inch, having a length, L8 of 0.38 inches, and may be positioned a distance L7 of 5.5 inches away from a hole 216, which may have a diameter D3 of 7/32 inches, which may be positioned a distance L9 of 2 inches away from the nearest end.

The part 210B may be formed similar to the second part 120 of the first bracket system 100, except that it may be L-shaped, where the second leg 210Bii is at the angle α to the first leg 210Bi. In one embodiment of part 210B, the length X3 of the first leg 210Bi may be roughly 2 inches, and the length Y3 of the second leg 210Bii may be 3 inches.

Installation of the second anchor bracket system 200 is shown in FIG. 19, and may proceed similar to the installation of the anchor bracket system 100, albeit with rotation of both the part 220 and the part 210B. It may be understood from FIG. 19 that loading of the post 213 by the pool cover hook/strap would cause deformation of both the part 220 and the part 210B, to eliminate the tapered gaps with the respective sides of the deck boards, similar to the above-described deformation experienced with the anchor bracket system 100. The anchor bracket system 200 may be particularly useful where the deck boards do not run parallel to the sides of the pool.

However, in an alternative embodiment of the second anchor bracket system 200 the part 220 may nonetheless be formed the same as part 210B in FIG. 19, i.e., each may be formed to be T-shaped, and each may also be formed for the angle α to be 90 degrees.

Figure 20:
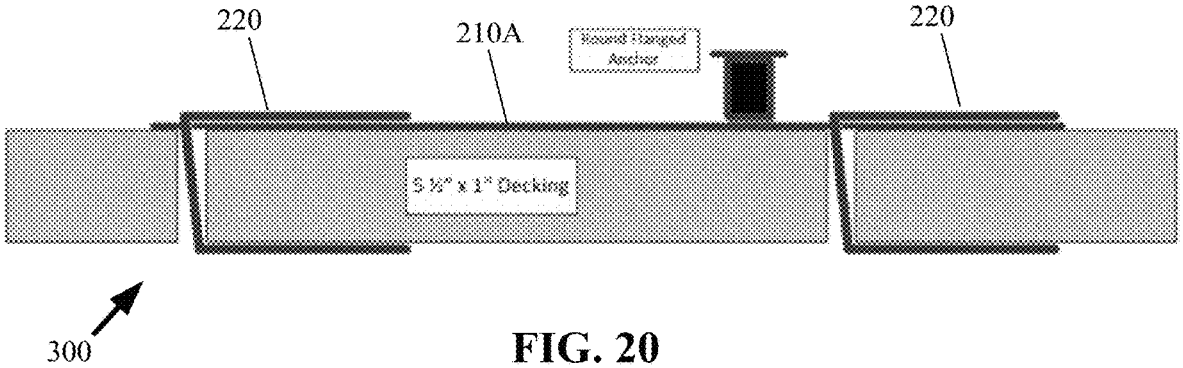
FIG. 20 shows first, second, and third parts of a third embodiment of a pool cover anchor as disclosed herein.

An anchor bracket system 300 is shown installed in FIG. 20, and which is constructed similar to the anchor bracket system 200, except that two instances of the part 220 with skewed legs may be used therein.

The parts that may be used, to form a fourth anchor bracket, system 400 are shown in FIGS. 21-23. A first part 410A may be formed similar to part 210A of the second anchor bracket system 200, with a post 413 having a flange 414, but it may have a hole 415 with a diameter D4 at the end opposite the post, rather than the slotted hole 215 in part 210A. The post 413 for the first part 410A may also be formed as a separate member, as seen in FIG. 22A, and may have a threaded shaft 413S protruding from one end for threaded attachment to any one of the plurality of threaded holes D5 in the first part 410A. Use of the plurality of holes D5, and the releasably attachable post 413 permits adjustments to the location of the post relative to a particular deck board location. The holes D5 may be spaced in regular increments, and in one embodiment, may be regularly spaced apart in the range being between 0.5 inches and 1.0 inches. The other end of the post 413 may have a hex-shaped recess 414H formed therein to receive an Allen wrench/key for threading the post to the first part. In another embodiment of the post (not shown), rather than having the threaded shaft 413S protruding from the lower end, a threaded hole may be formed therein, so that a flush-head bolt may be used to secure the first part 410A to the post. The first part 410A may also be formed with a hole 416 between the post 413 and the closest end of the plate, being separated therefrom by a distance L9, where the hole 415 is separated from hole 416 by a distance L8. In one embodiment, the overall length L10 of the plate may be roughly 7 inches, the closest portion of hole 416 may be positioned a distance L11 of roughly 0.5 inches from the end, and the hole 415 may be positioned a distance L12 of roughly 5.5 inches from the hole 416 (i.e., for 5/4×6 decking), where the holes 415 and 416 may each be 7/32 of an inch in diameter.

A second part 410B for the anchor bracket system 400 is shown in FIG. 23 and may be formed similar to the part 210B for the anchor system 200. The second part 410B may be generally L-shaped, but may have a first leg 410Bi that may be at an angle β to the second leg 410Bii, resulting in a length Y5 from the end of the second leg to the end of the first leg. A portion of the end of the second leg, 410Bii may have external threading formed thereon, which may be threaded for roughly ¾ of an Inch. In one embodiment of part 410B, the length X4 of the first leg 410Bi may be roughly 1.25 inches, the length Y4 of the second leg 416Bii may be roughly 2 inches, and the length Y5 may be roughly 1 11/16 inches.

Figure 24:
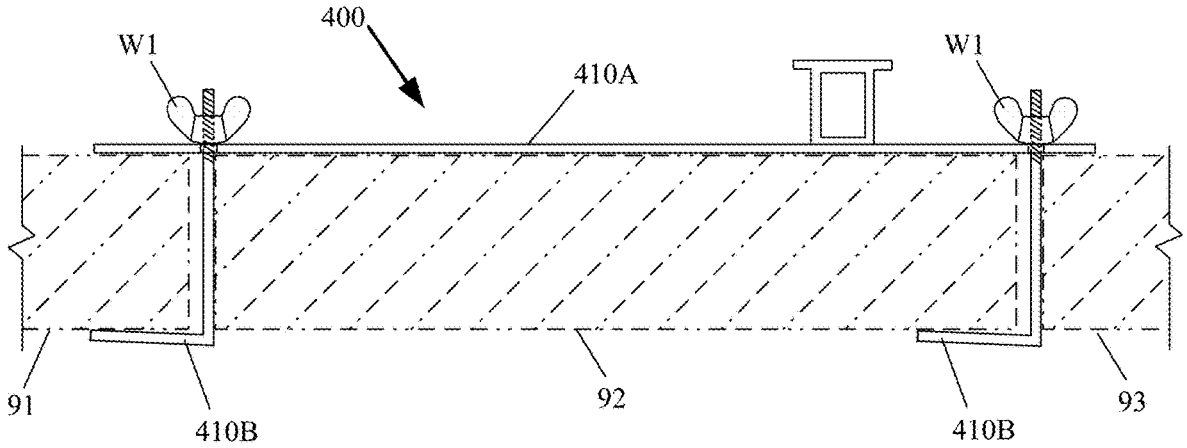
FIG. 24 shows the first and second parts of FIGS. 21-23 assembled together and installed with respect to a series of deck boards.
Figure 25:
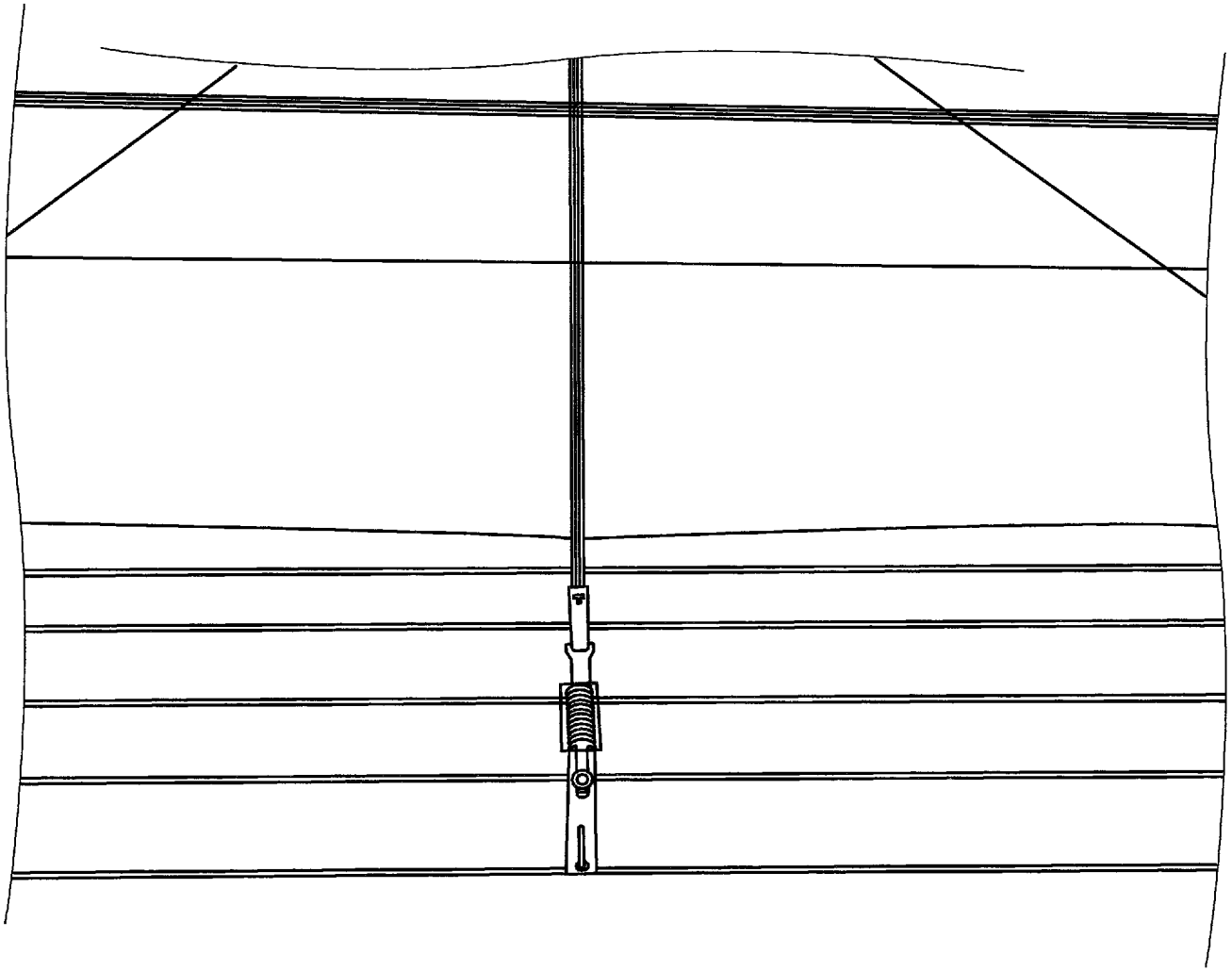
FIG. 25 illustrates the first part and second parts of a pool cover anchor, as disclosed herein, when installed on a pool deck, with the pool cover secured thereto.
Figure 26:
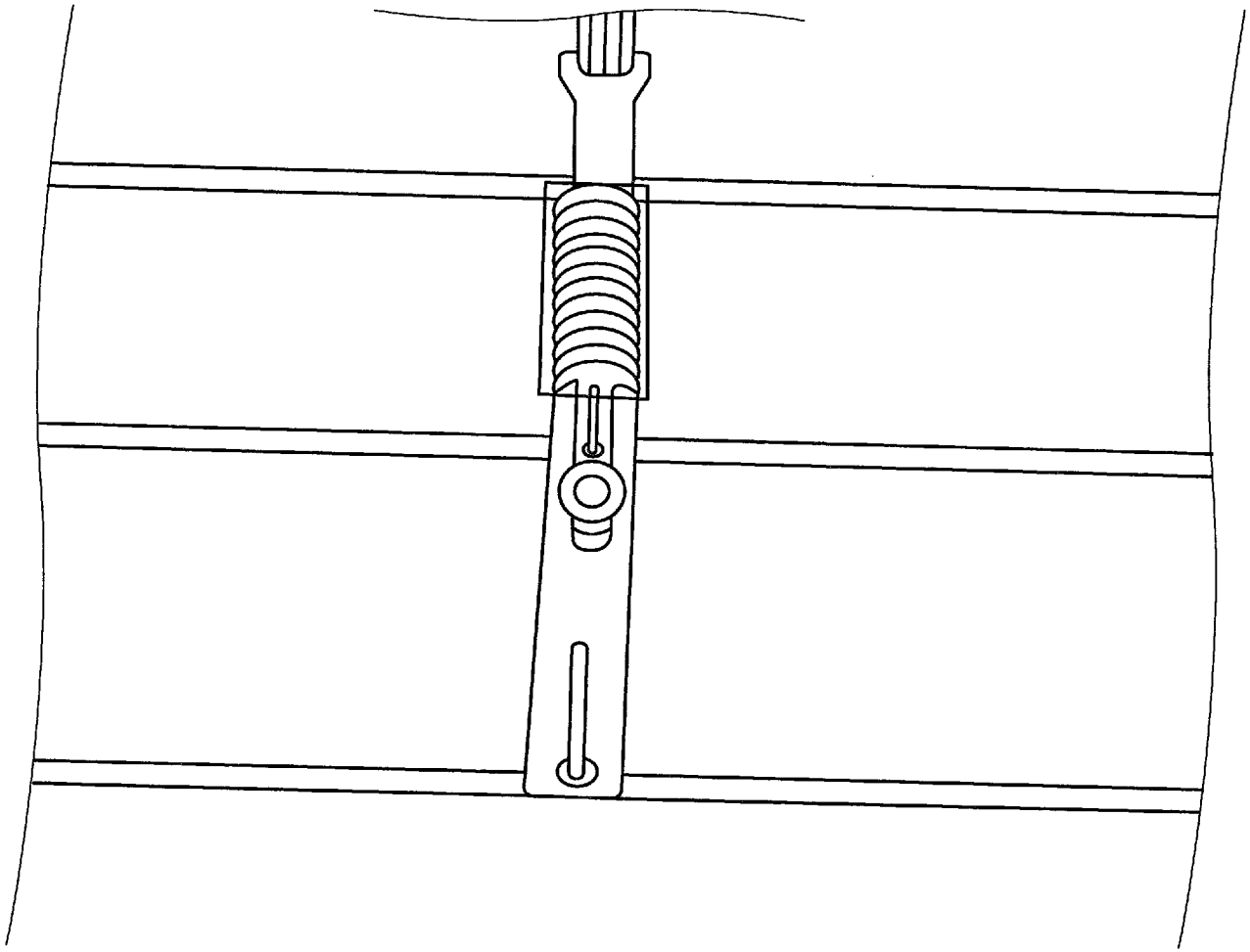
FIG. 26 is an enlarged detail view of the pool cover anchor shown in FIG. 25.
Figure 27:
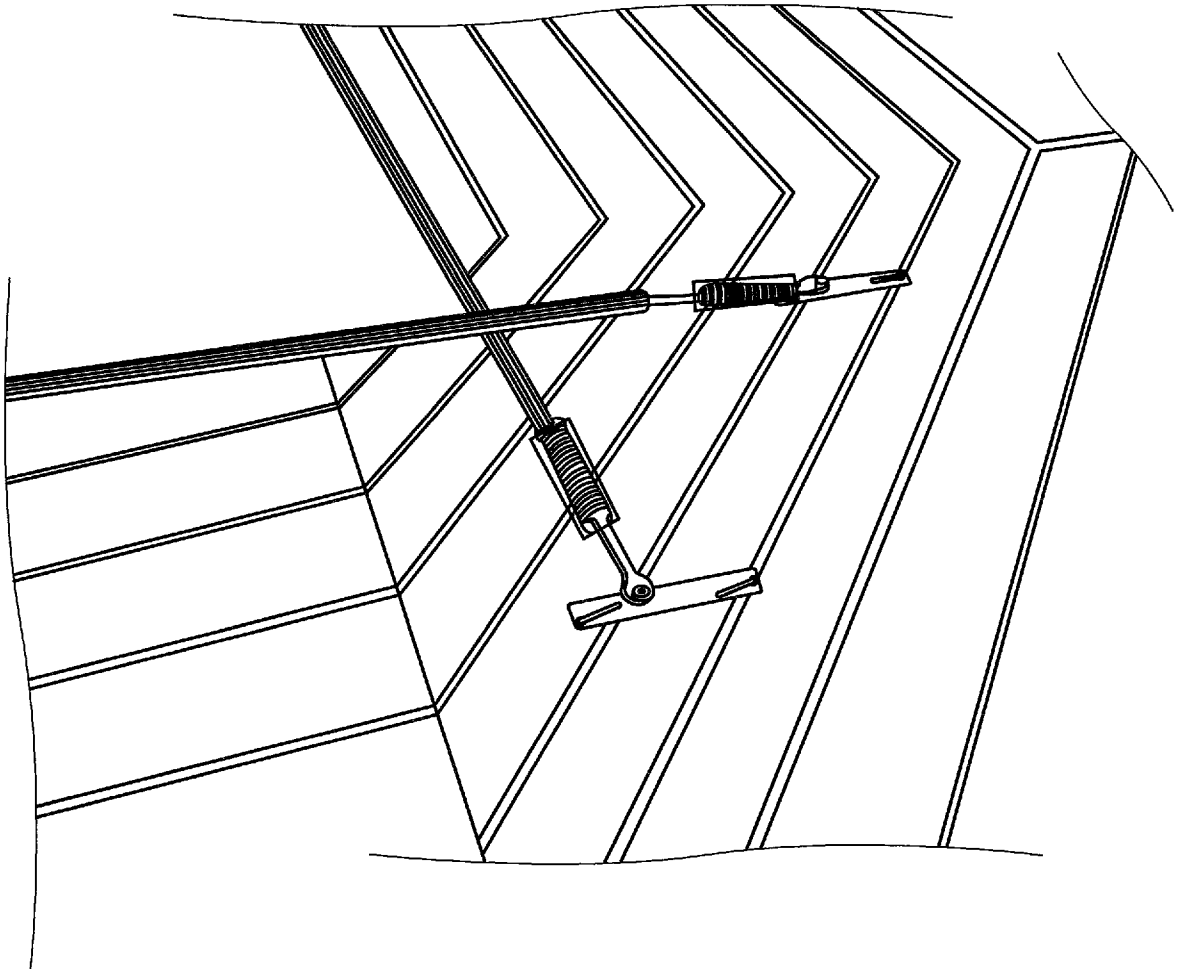
FIG. 27 illustrates the first part and second part of a pool cover anchor, as disclosed herein, when installed with respect to a pair of pool deck boards that are not oriented parallel to either side of the pool and thus support the pool cover straps at an angle to the axial direction of the first part.
Figure 28:
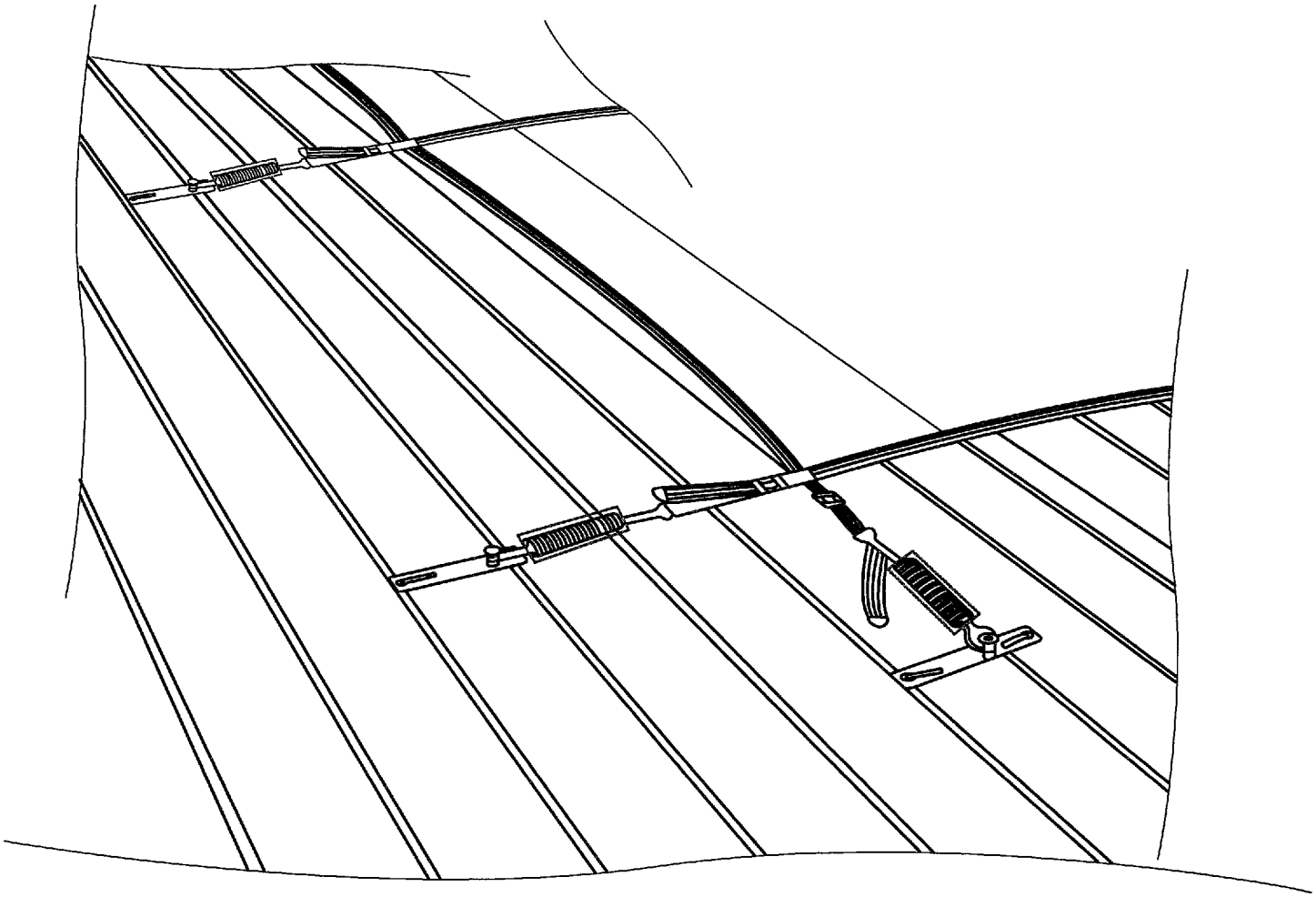
FIG. 28 illustrates a pair of the first part and second parts of a pool cover anchor, as disclosed herein, when installed with respect to a pair of pool deck boards that are oriented parallel to the sides of the pool.
Figure 29:
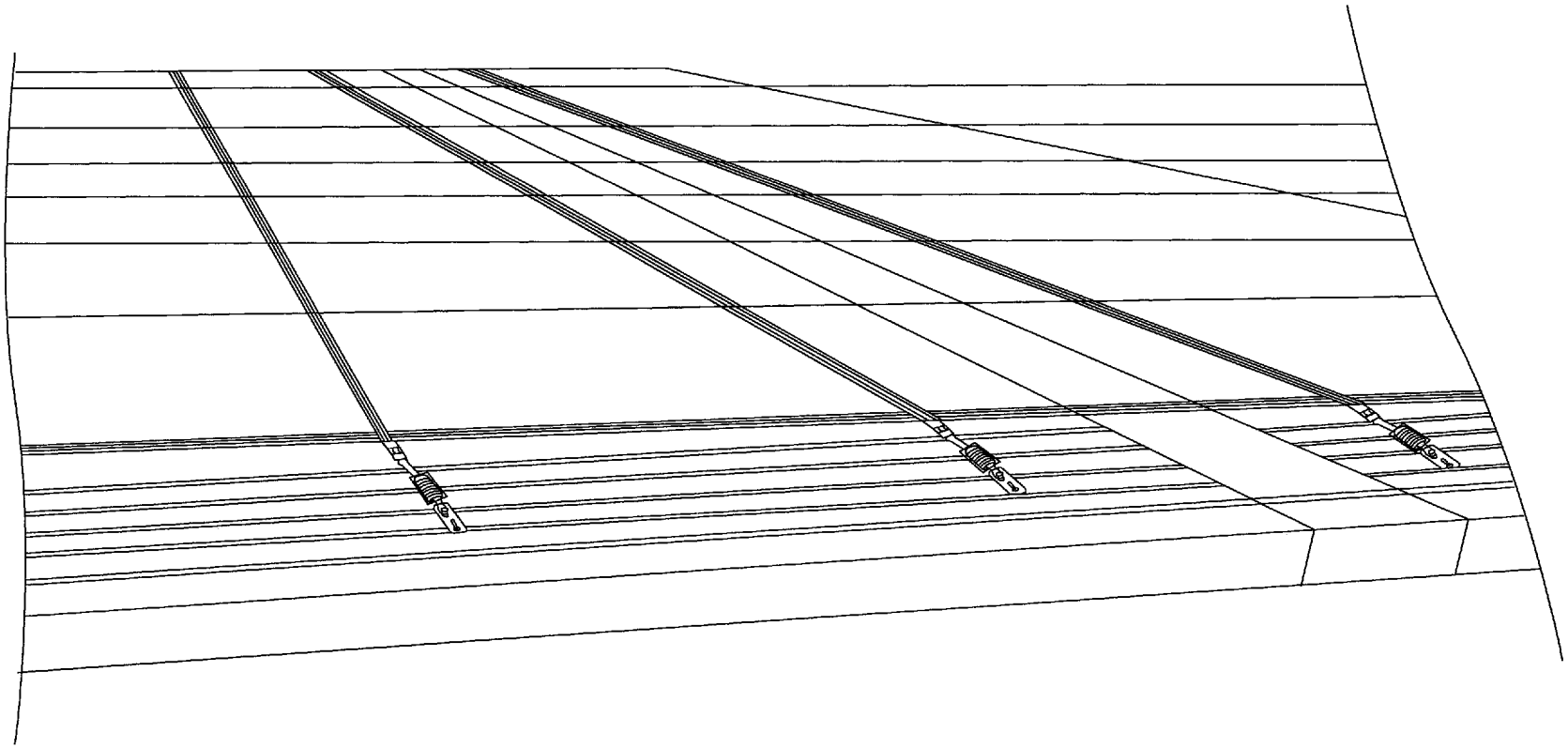
FIG. 29 illustrates a plurality of the first part and second parts of a pool cover anchor, as disclosed herein, when installed with respect to a corresponding plurality of pool deck boards to support a pool cover.
Figure 30:
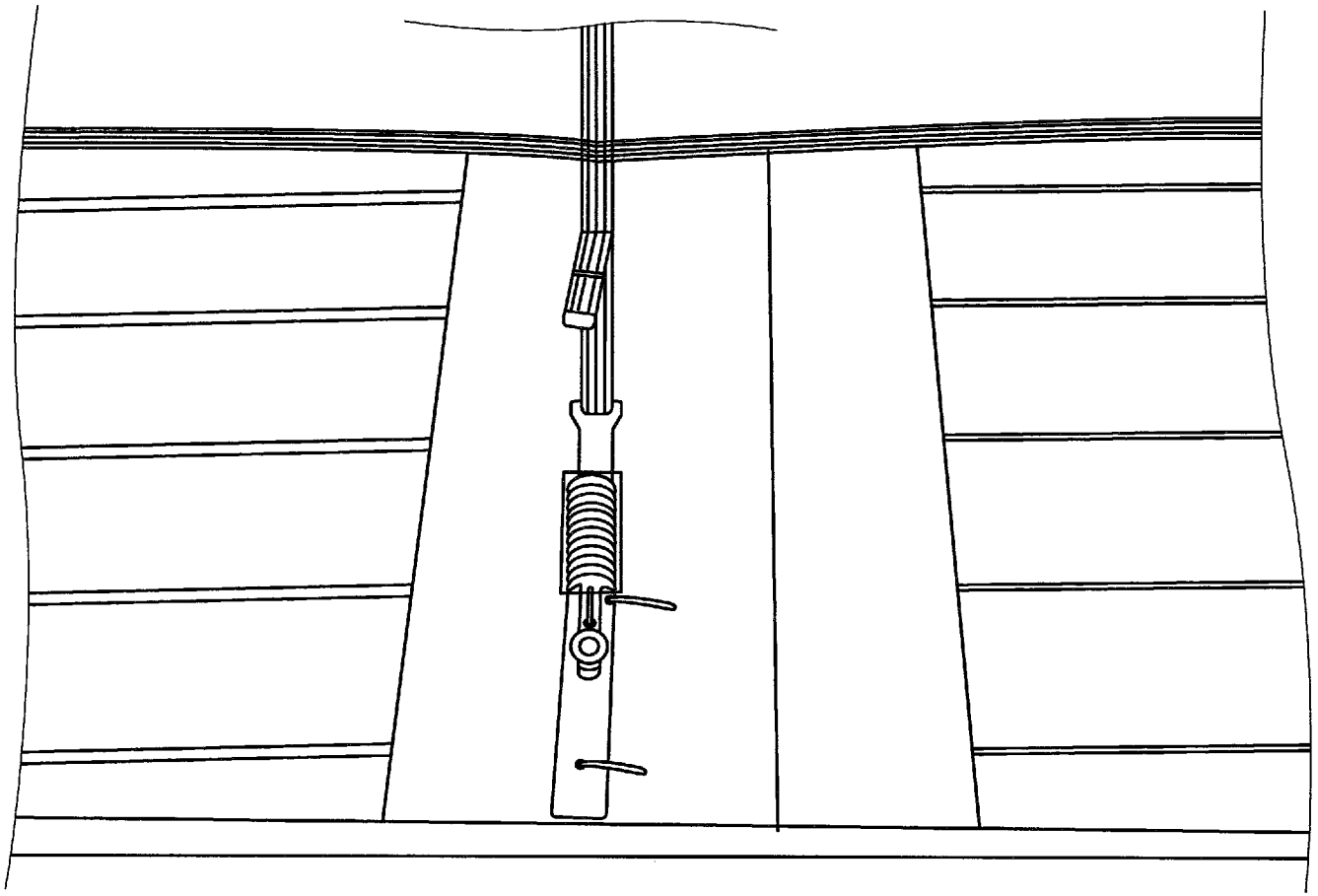
FIG. 30 illustrates the first part and second parts of a pool cover anchor, as disclosed herein, with a pool cover secured thereto.
Figure 31:
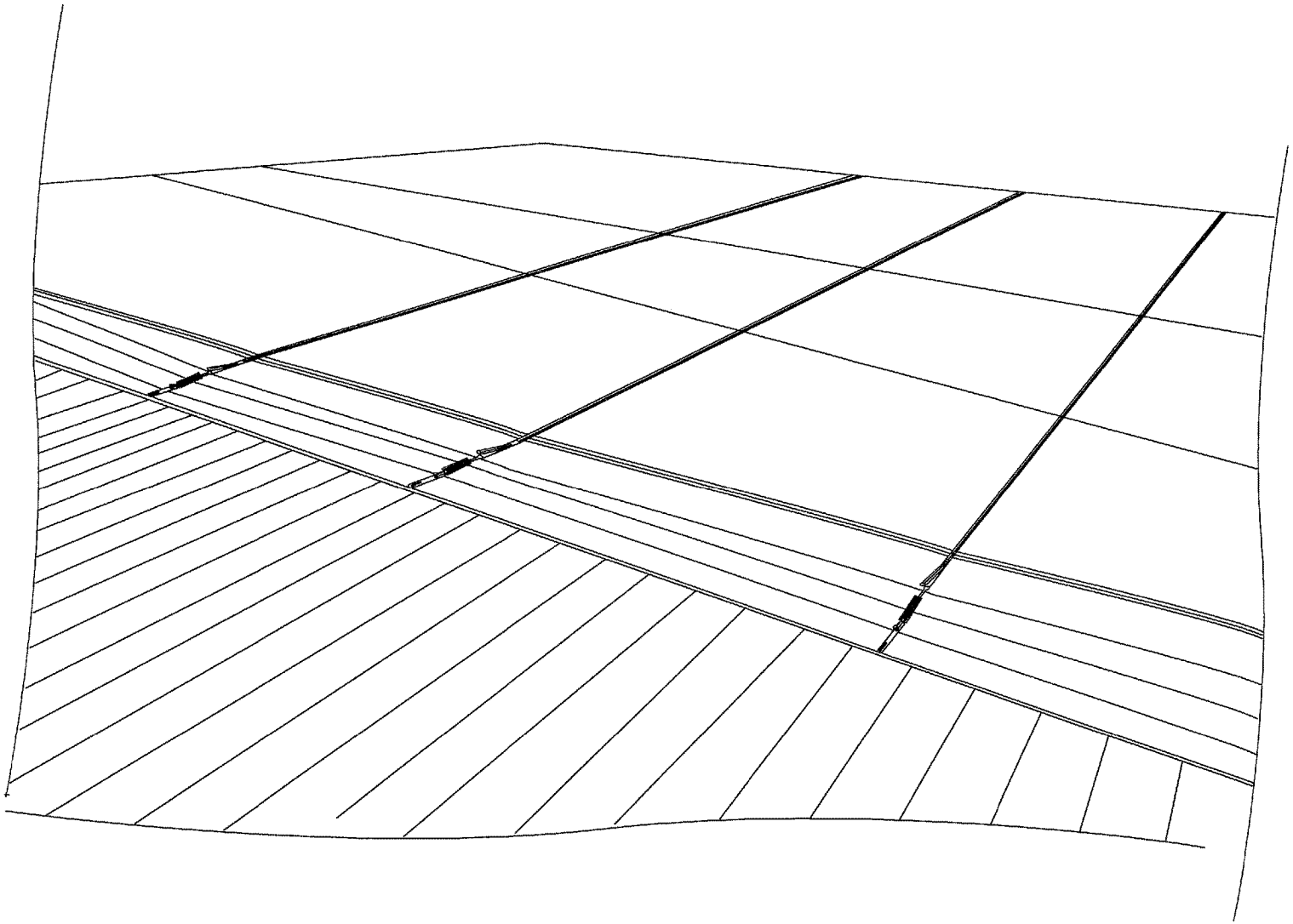
FIG. 31 illustrates a plurality of the first part and second parts of a pool cover anchor, as disclosed herein, when installed with respect to a corresponding plurality of pool deck boards to support a pool cover.

The fourth anchor bracket system 400 is shown installed with respect to deck boards 91/92/93 in FIG. 24, and may include the first part 410A, two instances of the second part 410B, with the threaded ends respectively received through the holes 415 and 416 in part 410A, and two wing nuts W1/W2 that are threaded onto those threaded ends to secure the post 413 with respect to the deck boards.

Figures 21A, 22B:
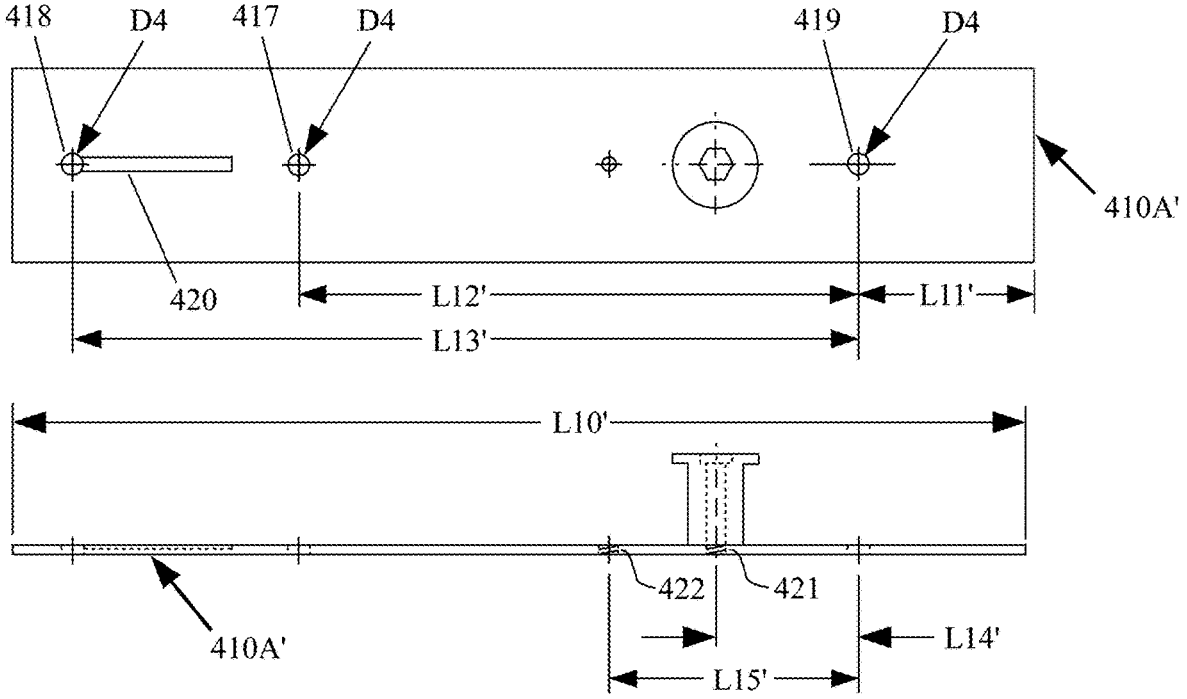
FIG. 21A illustrates a top view of the first part for a fifth embodiment of a pool, cover anchor as disclosed herein.
FIG. 22B Illustrates a side view of the first part shown in FIG. 22A.

A variation of the fourth anchor bracket system 400 may utilize the first part 410A' that is shown in FIGS. 21A and 22B instead of part 410A. The part 410A' may be formed similar to part 410A, but may have first and second holes 417 and 418 that may be positioned to respectively receive the part 410B when the anchor system is used on 5/4×4 deck boards or on 5/4×6 deck boards. The part 410A may also be formed with a groove 420 that may extend from the hole 417 part-way to the hole 418. The groove may be used for security purposes. In one embodiment, the overall length L10' of the first part 410A' may be about 8 inches and it may be formed of one-eighth inch thick plate; the hole 419 may be positioned a distance L11' of about 1.75 inches away from the end of the part; the hole 418 may be positioned a distance L12' of about 3.5 inches away from the hole 419; and the hole 417 may be positioned a distance L13' of about 5.5 inches away from the hole 419. The groove in that embodiment may be formed to be one-eighth inch, wide, two inches long, and 1/32" deep; and also, a hole 421 may positioned, at a distance L14' of 0.65 inches away from hole 419 and a hole 422 may be positioned a distance L15' of one inch away from hole 421.

The material used for the parts described herein may be selected for strength considerations and for good corrosion resistance properties. Therefore, in one embodiment, certain aluminum alloys may be used, including, but not limited to 6061 aluminum, and in other embodiments stainless steel may be used, including, but not limited to, 316 stainless steel. Certain plastic and/or composite and/or wood materials may also be used for certain other embodiments.

While illustrative implementations of one or more embodiments are provided hereinabove, those skilled in the art and having the benefit of the present disclosure will appreciate that further embodiments may be implemented with various changes within the scope of the disclosures made herein. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A pool cover anchor system, for use on deck boards surrounding a pool to support a hook of the pool cover, said pool cover anchor system comprising:

a first anchor part comprising:

an elongated member having a first end and a second end, said elongated member comprising a first opening and a second opening, and comprising a length configured for a first side of said elongated member to overlie and contact a first deck board and to at least overlie a portion of an adjacent second deck board when installed; and an anchor member configured to extend away from a second side of said elongated member, and configured for the hook of the pool cover to mount thereto;

a second anchor part comprising: a base, and first and second legs that extend away from opposite ends of said base to form a single unitary part being substantially U-shaped:

wherein a first portion of said base is pivotally mounted to said first opening in said elongated member of said first anchor part;

wherein a second portion of said base is configured to extend away from said first portion of said second anchor part, and to bear against the first deck board; and wherein said first leg is positioned proximate to said second side of said elongated member, to thereat being manually actuable between a first pivot position where said second leg is substantially perpendicular to said elongated member, and at least a second pivot position where said second leg is substantially parallel to said elongated member and configured to thereat be positioned beneath the first deck board when installed; and a third anchor part comprising:

a first portion pivotally mounted to said second opening in said elongated member of said first anchor part; and a second portion configured to extend away from said first portion of said third anchor part, and to bear against the second deck board.

2. The pool cover anchor system according to claim 1, wherein said third anchor part is substantially U-shaped, being formed the same as said second anchor art.

3. The pool cover anchor system according to claim 2, wherein each of said first and second legs are substantially parallel to each other, and each extends away from said base at an angle being in the range of about 90 degrees to 100 degrees.

4. The pool cover anchor system according to claim 1, wherein said third anchor part is substantially L-shaped.

5. The pool cover anchor system according to claim 1, wherein said anchor member extends away from said second side of said elongated member between said first opening and said second opening; and wherein said first opening, said anchor member, and said second opening are substantially aligned.

6. The pool cover anchor system according to claim 1, wherein each of said second anchor part and said third anchor part are bent into said U-shape from stock having a cross-sectional shape from the group of cross-sectional shapes consisting of: a circular cross-sectional shape, a square cross-sectional shape, and an octagonal cross-sectional shape.

7. The pool cover anchor system according to claim 1, wherein each of said second anchor part and said third anchor part formed with each of said first and second legs being welded to said base.

* * * * *